US007802791B2

(12) United States Patent
Yoshizawa et al.

(10) Patent No.: US 7,802,791 B2
(45) Date of Patent: Sep. 28, 2010

(54) IMAGE FORMING SYSTEM AND CONTROL METHOD THEREFOR, AND CONTROL UNIT FOR IMAGE FORMING APPARATUS

(75) Inventors: Ryuichi Yoshizawa, Yokohama (JP); Atsuya Takahashi, Mishima (JP); Akihiro Nakamura, Mishima (JP); Tadashi Okanishi, Suntou-gun (JP); Kazuhisa Maruyama, Sagamihara (JP); Kaoru Sato, Minamiashigara (JP)

(73) Assignee: Canon Kabushiki Kaisha, Tokyo (JP)

( * ) Notice: Subject to any disclaimer, the term of this patent is extended or adjusted under 35 U.S.C. 154(b) by 665 days.

(21) Appl. No.: 11/409,281

(22) Filed: Apr. 21, 2006

(65) Prior Publication Data

US 2006/0237902 A1 Oct. 26, 2006

(30) Foreign Application Priority Data

Apr. 25, 2005 (JP) ..... 2005-126338
Mar. 30, 2006 (JP) ..... 2006-095118

(51) Int. Cl.
*B65H 7/02* (2006.01)

(52) U.S. Cl. ..... 271/258.01; 271/265.01; 271/266

(58) Field of Classification Search ..... 271/3.15, 271/109, 270, 258.01, 265.01, 266; 399/16, 399/45, 388, 389, 390
See application file for complete search history.

(56) References Cited

U.S. PATENT DOCUMENTS 6,301,452 B1 10/2001 Yoshizawa
2003/0016976 A1* 1/2003 Harashima ..... 399/389
2006/0222394 A1* 10/2006 Koshida ..... 399/68

FOREIGN PATENT DOCUMENTS

JP 2000-190475 * 7/2000
JP 2000-305438 A 11/2000

* cited by examiner

*Primary Examiner*—Gregory W Adams
*Assistant Examiner*—Thomas A Morrison
(74) *Attorney, Agent, or Firm*—Canon USA Inc IP Div

(57) ABSTRACT

An image forming system including an image forming apparatus and a sheet feeding apparatus. The system includes: a first conveying unit conveying to the image forming apparatus a recording material; a second conveying unit conveying to an image forming unit of the image forming apparatus the recording material; a detector detecting a recording material type while the second conveying unit halts conveying the recording material; a first controller, based on detection by the detector, determining a speed for conveying the recording material to the image forming unit, and conveying the recording material at the conveying speed; and a second controller controlling recording material conveying speeds of the first conveying unit. Before the recording material reaches the second conveying unit, the second controller maintains a first conveying speed, and after the recording material reaches the second convey unit, maintains a second conveying speed determined by the first control unit.

2 Claims, 16 Drawing Sheets

IMAGE FORMING SYSTEM AND CONTROL METHOD THEREFOR, AND CONTROL UNIT FOR IMAGE FORMING APPARATUS

BACKGROUND OF THE INVENTION

1. Field of the Invention

The present invention relates to an image forming system, such as a copier or printer of an electrophotographic type or an electrostatic storage type.

2. Description of the Related Art

Among image forming apparatuses, such as copiers and printers of an electrophotographic type and of an electrostatic storage type, image forming apparatuses wherein a sheet feeding unit is located at the lower portion of the main body have long been known. Further, image forming apparatuses are also known wherein the image forming processing speed can be changed in accordance with the type (the sheet type) of the sheets supplied for image forming (see Japanese Patent Laid-Open Publication No. 2000-305438, corresponding to U.S. Pat. No. 6,301,452).

The sheet conveying operation of an image forming apparatus in FIGS. 13A to 13C, for example, will be explained while referring to FIG. 14. A controller transmits, to an engine controller, a print reservation command that designates a main body sheet feeding unit 20*a* and a sheet type detection mode (401), and thereafter, transmits a print start command (402). Upon receiving both commands, the engine controller prepares for printing (403), and initiates the feeding of sheets from the main body sheet feeding unit 20*a* (404, FIG. 13A). When a sheet fed in this manner has reached a sheet detection position (405, FIG. 13B), the engine controller temporarily halts the conveying of the sheet (406), and detects the sheet type (407).

When the sheet type has been identified, the engine controller switches to an image forming condition consonant with the sheet type that was identified (408), and resumes sheet conveying (409). Thereafter, the engine controller outputs a vertical sync signal (a /TOP signal) to permit the controller to output image data (410, FIG. 13C).

When the sheets employed for this image forming apparatus are plain paper, for example, the feeding speed for registration rollers 15 is set equal to the conveying speed of cassette convey rollers 22*a* and intermediate convey rollers 23*a*. When the sheets are thick paper, for example, the feeding speed for the registration rollers 15 is set lower than the conveying speed of the cassette convey rollers 22*a* and the intermediate convey rollers 23*a*.

Further, another image forming system is also known wherein, as shown in FIGS. 15A to 15D, an external sheet feeding apparatus 20*b* is attached to the bottom of the main body sheet feeding unit 20*a*. The sheet conveying operation of this image forming system will now be described while referring to FIG. 16. When printing preparation is completed, sheets stacked in the external sheet feeding apparatus 20*b* are separated by a cassette pickup roller 21*b* (601, 602; FIG. 15A), and each sheet is conveyed to a merging point 24 by cassette convey rollers 22*b* and intermediate convey rollers 23*b* (603 to 605; FIG. 15B). Then, the sheet is conveyed by intermediate convey rollers 23*a*, as well as by the cassette convey rollers 22*b* and the intermediate convey rollers 23*b*, and when the leading edge of the sheet is detected by a registration sensor 11, sheet conveying is temporarily halted (606 to 610; FIG. 15C).

In this temporary halted state, the type of sheet is detected by a sheet type detection sensor 12, which is located between the intermediate convey rollers 23*b* and the registration rollers 15 (611). When the sheet type has been identified, the image forming condition is changed to one in consonance with the identified sheet type (612).

At a predetermined timing, the sheet begins to be conveyed to a transfer conveying belt 9 by the registration rollers 15 and the intermediate convey rollers 23*a* and 23*b* (613 and 614), and a vertical sync signal (a /TOP signal) is output to begin the output of image data (615).

When sheets are plain paper, for example, the sheet conveying speed for the registration rollers 15 and the intermediate convey rollers 23*a* equals the sheet conveying speed for the intermediate convey rollers 23*b*, and problems, such as the jamming of sheets, do not occur.

However, when sheets are thick paper, for example, the conveying speed for the registration rollers 15 and the intermediate convey rollers 23*a* is lower than the conveying speed for the intermediate convey rollers 23*b*, i.e., the conveying speeds are not equal, the jamming of sheets occurs (616; FIG. 15D).

Accordingly, needed is an improved image forming system and a control method therefore, and a control unit for an image forming apparatus.

Also needed is an image forming system wherein a recording material, supplied from an externally connected feeding unit, can also be normally conveyed, a control method therefor, and a control unit for an image forming apparatus.

Also needed is an image forming system wherein a recording material to which an image has been fixed can also be normally conveyed to an externally connected sheet delivery apparatus, a control method therefor, and a control unit for an image forming apparatus.

SUMMARY OF THE INVENTION

The present invention is directed to an image forming system. In one aspect of the present invention, an image forming system including an image forming apparatus and a sheet feeding apparatus, includes: a first conveying unit configured to convey to the image forming apparatus a recording material fed by the sheet feeding apparatus; a second conveying unit configured to convey to an image forming unit of the image forming apparatus the recording material that has been conveyed by the first conveying unit; a detector detecting a type of the recording material while the recording material is halted by the second conveying unit; a first controller, based on detection by the detector, configured to determine a conveying speed for conveying the recording material to the image forming unit of the image forming apparatus, and to convey the recording material at the determined conveying speed; and a second controller controlling speeds at which the first conveying unit is to convey the recording material. Before the recording material fed by the sheet feeding apparatus reaches the second conveying unit, the second controller maintains a first conveying speed for the recording material, and after the recording material reaches the second convey unit, maintains a second conveying speed that the first control unit determines for the conveying of the recording material.

According to another aspect of the present invention, a control method, for an image forming system that includes an image forming apparatus and a sheet feeding apparatus, includes: a first conveying step of conveying a recording material from the sheet feeding apparatus to the image forming apparatus; a determination step of temporarily halting the recording material being conveyed to the image forming apparatus in the first conveying step, and of determining the type of the recording material; a receiving step of receiving information related to a first conveying speed from the image forming apparatus where the first conveying speed is based on the type of the recording material determined at the determination step; and a second conveying step of resuming the conveying of the temporarily halted recording material, in accordance with information related to the first conveying speed.

According to yet another aspect of the present invention, a controller for an image forming apparatus includes: a transmission unit configured to transmit information and a signal to a sheet feeding controller of a sheet feeding apparatus connected to the image forming apparatus; and a control unit detecting a type of recording material to be conveyed to the image forming apparatus, and based on the detected type, determining an image forming speed. Wherein, before detecting the type of recording material, the transmission unit transmits, to the sheet feeding controller, information related to a first conveying speed for the recording material and a sheet feed signal for a recording material start feeding instruction to start the feeding of a recording material, and wherein, after detecting the type of recording material, the transmission unit transmits, to the sheet feeding controller, information related to the image forming speed and a feed resumption signal to instruct feeding resumption of the recording material.

Further features of the present invention will become apparent from the following description of exemplary embodiments (with reference to the attached drawings).

DESCRIPTION OF THE EMBODIMENTS

The embodiments of the present invention will now be described in detail while referring to the accompanying drawings.

The present invention can be applied to an apparatus to which an external apparatus, for which control is provided by a controller, can be connected, and is not limited to an image forming apparatus that employs an electrophotographic process.

First Embodiment

Figure 1:
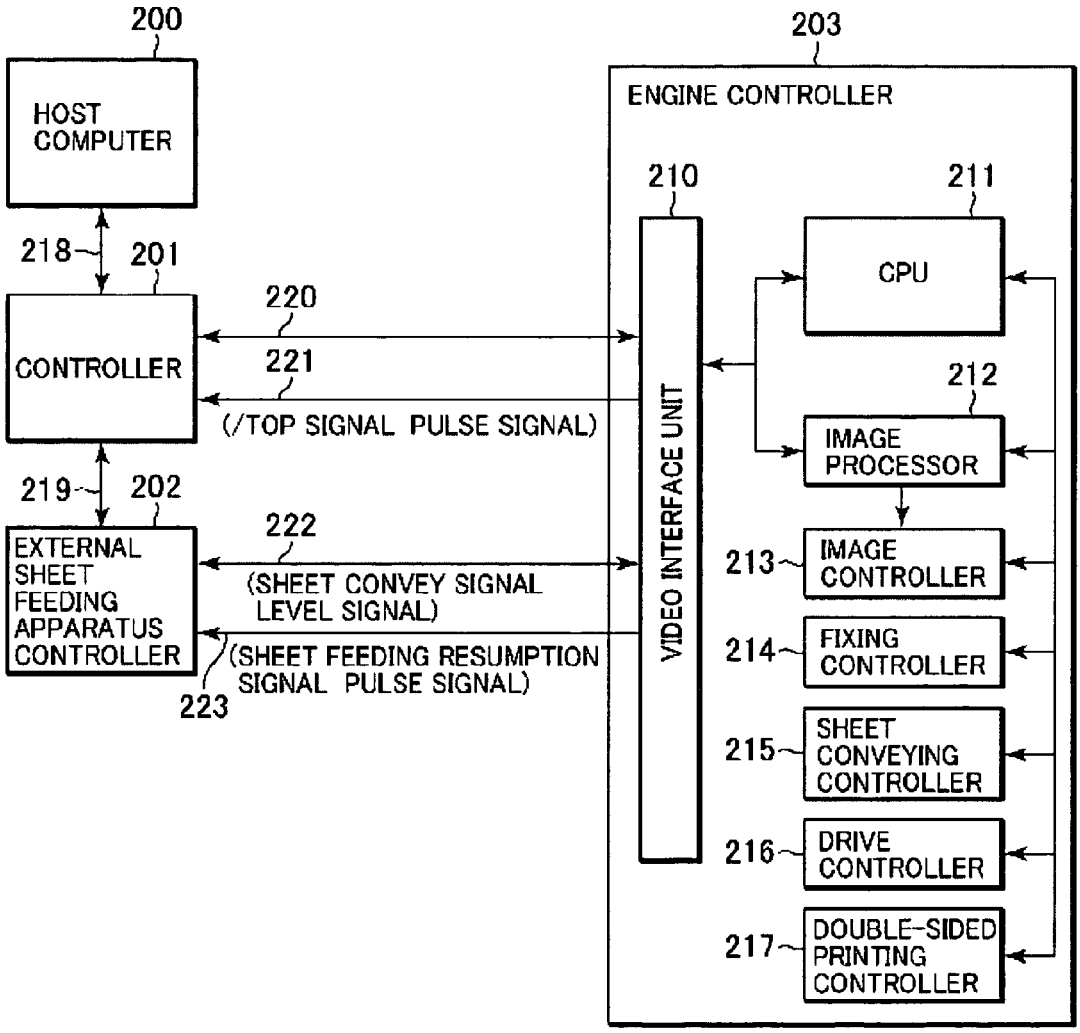
FIG. 1 is a block diagram showing a first embodiment of the present invention.

A first embodiment of the present invention is illustrated in FIG. 1. Shown therein is an example color laser beam printer for which the structure is shown in FIG. 2.

The color laser beam printer, which is an image forming system according to this embodiment, includes, as sheet feeders, not only a main body sheet feeding unit 20*a* but also an external sheet feeding apparatus 20*b*. When a sheet type is established, a sheet conveying speed (also called an image forming speed) employed during image forming is changed to a sheet conveying speed consonant with the established sheet type.

(General Configuration)

Figure 2:
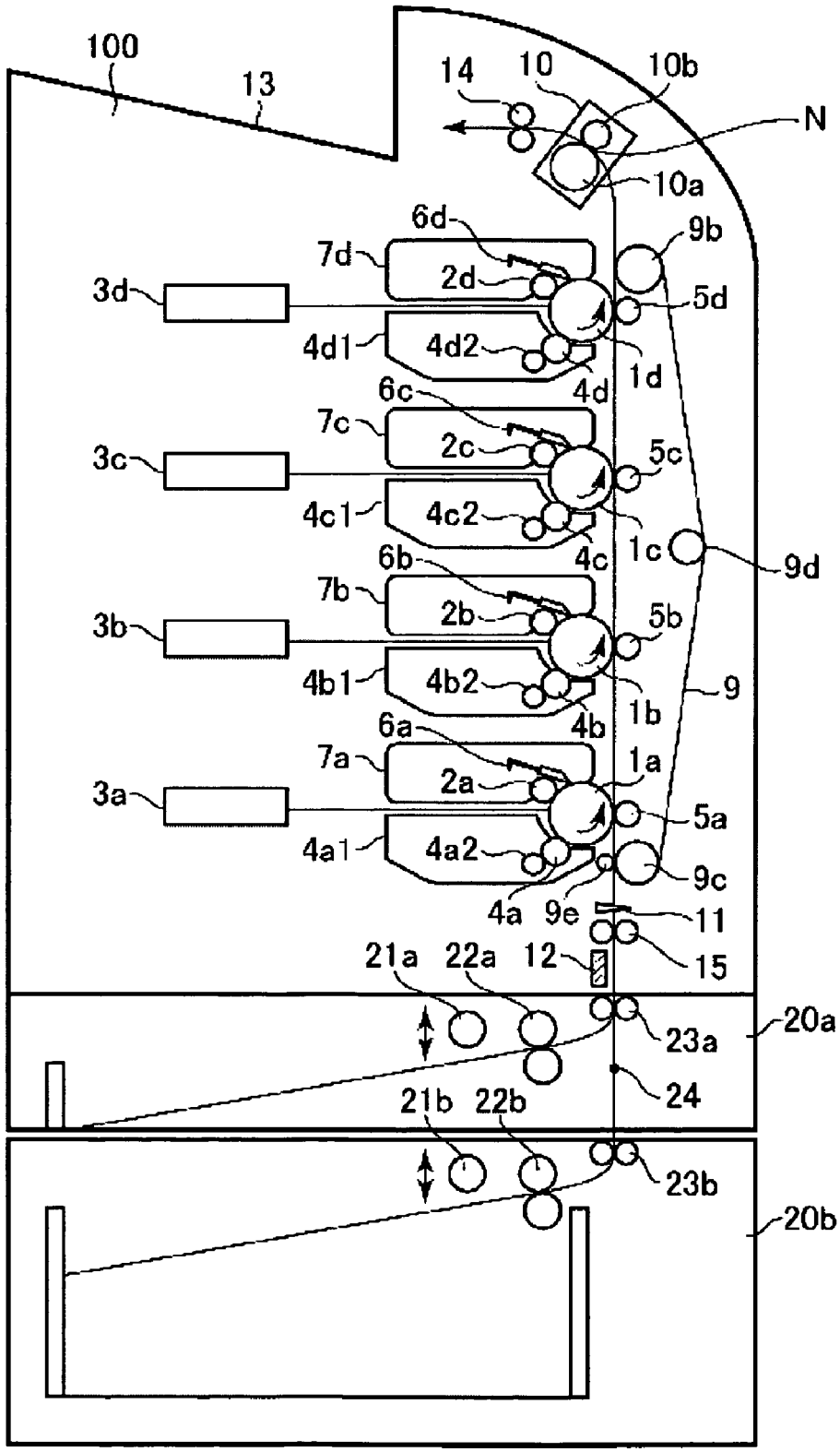
FIG. 2 is a cross-sectional view of the structure of a color laser beam printer in FIG. 1.

While referring to FIG. 2, a color laser beam printer 100 includes four photosensitive drums 1*a* to 1*d*, which are image bearing bodies. Around the photosensitive drums 1*a* to 1*d*, the following members are arranged, in the named order, in accordance with the rotational directions: charging rollers 2*a* to 2*d*, which are charging devices for uniformly electrifying the surfaces of the photosensitive drums 1*a* to 1*d*; scanner units 3*a* to 3*d*, which are exposure devices for emitting laser beams, based on image information, for forming electrostatic latent images on the photosensitive drums 1*a* to 1*d*; developing devices (4*a*, 4*a*1 and 4*a*2) to (4*d*, 4*d*1 and 4*d*2), which are development devices for attaching toner to the electrostatic latent images to visualize these images as toner images; transfer rollers 5*a* to 5*d*, which are transfer members for transferring toner images from the photosensitive drums 1*a* to 1*d* to a sheet; and cleaners 6*a* to 6*d*, which are cleaning devices for removing toner remaining on the photosensitive drums 1*a* to 1*d* following the image transfer. These components constitute an image forming section.

The photosensitive drums 1*a* to 1*d*, the charging rollers 2*a* to 2*d*, the developing devices and the cleaners 6*a* to 6*d* are packaged together to form process cartridges 7*a* to 7*d*, which are detachable from an image forming apparatus.

A sheet fed from the main body sheet feeding unit 20*a* or from the external sheet feeding apparatus 20*b* is conveyed to the image forming section by a transfer and conveying belt 9, which is a conveying device. Then, toner images formed using different colors are sequentially transferred to the sheet to obtain a multi-color image. Thereafter, the image is thermally fixed to the sheet by a fixing device 10, and the resultant sheet is delivered, by a delivery roller pair 14, to a sheet discharge area 13 whereat such sheets are stacked.

(Sheet Feeding Unit)

The main body sheet feeding unit 20*a* is a unit wherein multiple recording media are stored. The sheets in the main body sheet feeding unit 20*a* are separately fed, one following the other, by a cassette pickup roller 21*a*. Each sheet is conveyed to registration rollers 15 by cassette convey rollers 22*a* and intermediate convey rollers 23*a*, and is thereafter conveyed, at a predetermined timing, to the transfer conveying belt 9 by the registration rollers 15.

The external sheet feeding apparatus 20*b* is an optional sheet feeding apparatus, wherein multiple recording media are stored, that is detachable from an image forming apparatus.

The sheets in the external sheet feeding apparatus 20*b* are separated and fed, one following the other, by a cassette pickup roller 21*b*, and are individually conveyed to the registration rollers 15 by convey rollers 22*b* and intermediate convey rollers 23*b* and 23*a*. Thereafter, the sheets are individually conveyed, at a predetermined timing, to the transferring/conveying belt 9 by the registration rollers 15.

(Image Forming Section)

The photosensitive drums 1*a* to 1*d* are formed by depositing an organic photoconductive (OPC) layer on the outer surface of an aluminum cylinder. Both ends of each of the photosensitive drums 1*a* to 1*d* are rotatably supported by flanges, and when a driving force, produced by a drive motor (not shown), is applied at one end of each photosensitive drum 1*a* to 1*d*, the photosensitive drums 1*a* to 1*d* are rotated counterclockwise, as indicated by arrows in FIG. 2.

The charging rollers 2*a* to 2*d* are conductive, roller shaped members. When the charging rollers 2*a* to 2*d* are brought into contact with the surfaces of the photosensitive drums 1*a* to 1*d* and a biased charging voltage, supplied by a power source (not shown), is applied to these members, the surfaces of the photosensitive drums 1*a* to 1*d* can be uniformly electrified.

The scanner units 3*a* to 3*d* include polygon mirrors toward which image signal consonant image light, emitted by laser diodes (not shown), is directed.

The developing devices respectively include: toner storage units 4*a*1 to 4*d*1, in which black, cyan, magenta and yellow toners are respectively stored; supply rollers 4*a*2 to 4*d*2, for supplying toner; and developing rollers 4*a* to 4*d*, which are positioned adjacent to the photosensitive drums 1*a* to 1*d* and are rotated by drivers (not shown), and which perform image development upon the application of a biased development voltage supplied by a biased development power source (not shown).

Further, within an area delimited and defined by the transferring/conveying belt 9, which serves as a conveying device and which will be described below, transfer members 5*a* to 5*d*, which contact the transferring/conveying belt 9, are respectively arranged opposite the photosensitive drums 1*a* to 1*d*. These transfer members 5*a* to 5*d* are connected by a power source (not shown) for applying transfer bias. An electric charge having a positive polarity is applied to a sheet by the transfer members 5*a* to 5*d* via the transferring/conveying belt 9. Then, using the thus established electric field, individually colored toner images having a negative polarity, which are formed on the photosensitive drums 1*a* to 1*d*, are sequentially transferred to the sheet as it is brought into contact with the photosensitive drums 1*a* to 1*d*. In this manner, a multi-colored image can be obtained.

(Sheet Conveying)

After a sheet has been fed by the intermediate convey rollers 23*a* or 23*b*, the type of sheet is detected by the sheet type detection sensor 12 located between the intermediate convey rollers 23*a* and the registration rollers 15. After the sheet type has been identified, the sheet conveying speed is adjusted in consonance with the identified sheet type, and the sheet, which has been held momentarily by the registration rollers 15, is then conveyed to the image forming area by the transfer conveying belt 9.

The transfer conveying belt 9 is extended around and supported by three members, a drive roller 9*b* and driven rolling members 9*c* and 9*d*, which are located opposite the photosensitive drums 1*a* to 1*d*. It should be noted that the positioning of the drive roller 9*b* and the driven rolling member 9*c* may be inverted, i.e., the members 9*b* and 9*d* may be driven rolling members and the member 9*c* may be a drive roller.

At the most upstream position along the transferring/conveying belt 9, an attraction roller 9*e* is located for, with the transferring/conveying belt 9, griping a sheet and for attracting the sheet to the transferring/conveying belt 9. During the conveying of a sheet, through the application of a voltage to the attraction roller 9*e*, an electric field is formed between the attraction roller 9*e* and the opposite driven rolling member 9*c*, so that dielectric polarization is generated between the transferring/conveying belt 9 and the sheet, and an electrostatic attraction force is exerted between the two.

The transferring/conveying belt 9 is impelled by the drive roller 9*b* so that a sheet, electrostatically attracted to the surface of the transferring/conveying belt 9, can be brought into contact with the photosensitive drums 1*a* to id. Thus, at individual transfer positions, the toner images on the photosensitive drums 1*a* to 1*d* can be transferred to the sheet that is electrostatically attracted to the transferring/conveying belt 9.

(Fixing Section)

The fixing device 10 fixes a toner image to a sheet by applying heat and pressure, and includes a fixing roller 10*a* and a flexible pressure roller 10*b*. By applying a predetermined pressing force, the flexible pressure roller 10*b* forms, together with the fixing roller 10*a*, a fixing nip portion N having a predetermined width.

When the fixing nip portion N is adjusted to a predetermined temperature, a sheet to which an unfixed toner image has been transferred is conveyed from the image forming section and is gripped at the fixing nip portion N. Specifically, the sheet is fed between the fixing roller 10*a* and the flexible pressure roller 10*b*, with the image side facing upward, i.e., opposite the fixing roller 10*a*. At the fixing nip portion N, while the image side closely contacts the outer face of the fixing roller 10*a*, the sheet is gripped and conveyed by the fixing roller 10*a* through the fixing nip portion N.

During the process through which the sheet is gripped and conveyed by the fixing roller 10*a* and through the fixing nip portion N, the sheet is heated by the fixing roller 10*a*, thermally fixing the toner image to the sheet. It should be noted that instead of the fixing roller 10*a*, another fixing device, such as a film or a belt, may be employed.

Now referring to FIG. 1, a controller 201 communicates with a host computer 200, an external sheet feeding apparatus controller 202 and an engine controller 203 via communication lines 218, 219 and 220. Thus, the controller 201 receives image information and a print instruction from the host computer 200, and analyzes the received image information and converts the image information into bit data. Then, the controller 201 transmits the bit data, via a video interface unit 210, to the engine controller 203 as a print reservation command, a print start command or a video signal for each sheet.

The print reservation command is a command including information that designates, for each sheet, a sheet feeding unit, a printing form and a sheet delivery unit, and information relevant to sheet size.

The controller 201 then transmits the print reservation command to the engine controller 203, in accordance with a print instruction received from the host computer 200. When sheets are to be supplied from the external sheet feeding apparatus 20*b*, the sheet feeding reservation command is also transmitted to the external sheet feeding apparatus controller 202. Furthermore, the controller 201 manages the print reservation command and the sheet feeding reservation command in correlation with each sheet.

Upon receiving the sheet feeding reservation command from the controller 201, the external sheet feeding apparatus controller 202 starts a sheet feeding operation and conveys a sheet to a juncture 24 (see FIG. 2), where the sheet enters the main body of an engine.

At the time printing is enabled, the controller 201 transmits a print start command to the engine controller 203.

Upon receiving the print start command, the engine controller 203 conveys the sheet that has been held at the juncture 24 (FIG. 2) until the leading edge of the sheet reaches the registration sensor 11 (hereinafter, the position whereat the leading edge of the sheet is detected by the registration sensor 11 is called a "sheet detection position"). Then, sheet conveying is temporarily halted, and the sheet type detection sensor 12 detects the type of sheet being fed. Thereafter, the conveying of the sheet by the registration rollers 15 is restarted, a /TOP signal 221 (FIG. 1), which is used as a reference timing for outputting a video signal, is output, and the printing operation is begun.

In accordance with a sheet convey signal 222 output by the engine controller 203, the external sheet feeding apparatus controller 202 conveys a sheet from the juncture 24 (FIG. 2) to the sheet detection position, and in accordance with a sheet feeding resumption signal 223 output by the engine controller 203, resumes the conveying of the sheet, using the registration rollers 15, after the sheet type detection has been completed.

In this embodiment, in accordance with the sheet convey signal 222 and the sheet feeding resumption signal 223, the external sheet feeding apparatus controller 202 permits the engine to perform sheet conveying. However, independent signal lines need not always be employed. The sheet conveying may be performed, for example, through communication performed between the engine controller 203 and the controller 201, or through communication performed between the controller 201 and the external sheet feeding apparatus controller 202.

The engine controller 203 includes a CPU 211 and multiple controllers. The CPU 211 manages these controllers and provides control for the entire operation of the engine controller 203.

In FIG. 1, an image processor 212 and an image controller 213 are respectively controllers for processing bit data received from the controller 201 and for outputting the resultant data. A fixing controller 214 provides control, for example, for a fixing temperature for the fixing device 10, and a sheet conveying controller 215 provides control for the recording material conveying operation of the image forming apparatus. A drive controller 216 provides control for driving motors in the individual sections of the image forming apparatus, and a double-sided printing controller 217 provides control for the double-sided printing operation (since, however, double-sided printing is not directly related to the present invention, the configuration therefor is not shown).

The video interface unit 210 is a transmitter through which the engine controller 203 communicates with or exchanges signals with the controller 201 and the external sheet feeding apparatus controller 202. The above described controllers may be constituted by hardware, such as ASIC, or may be provided as programs that are stored in the ROM in the CPU 211.

Figure 3:
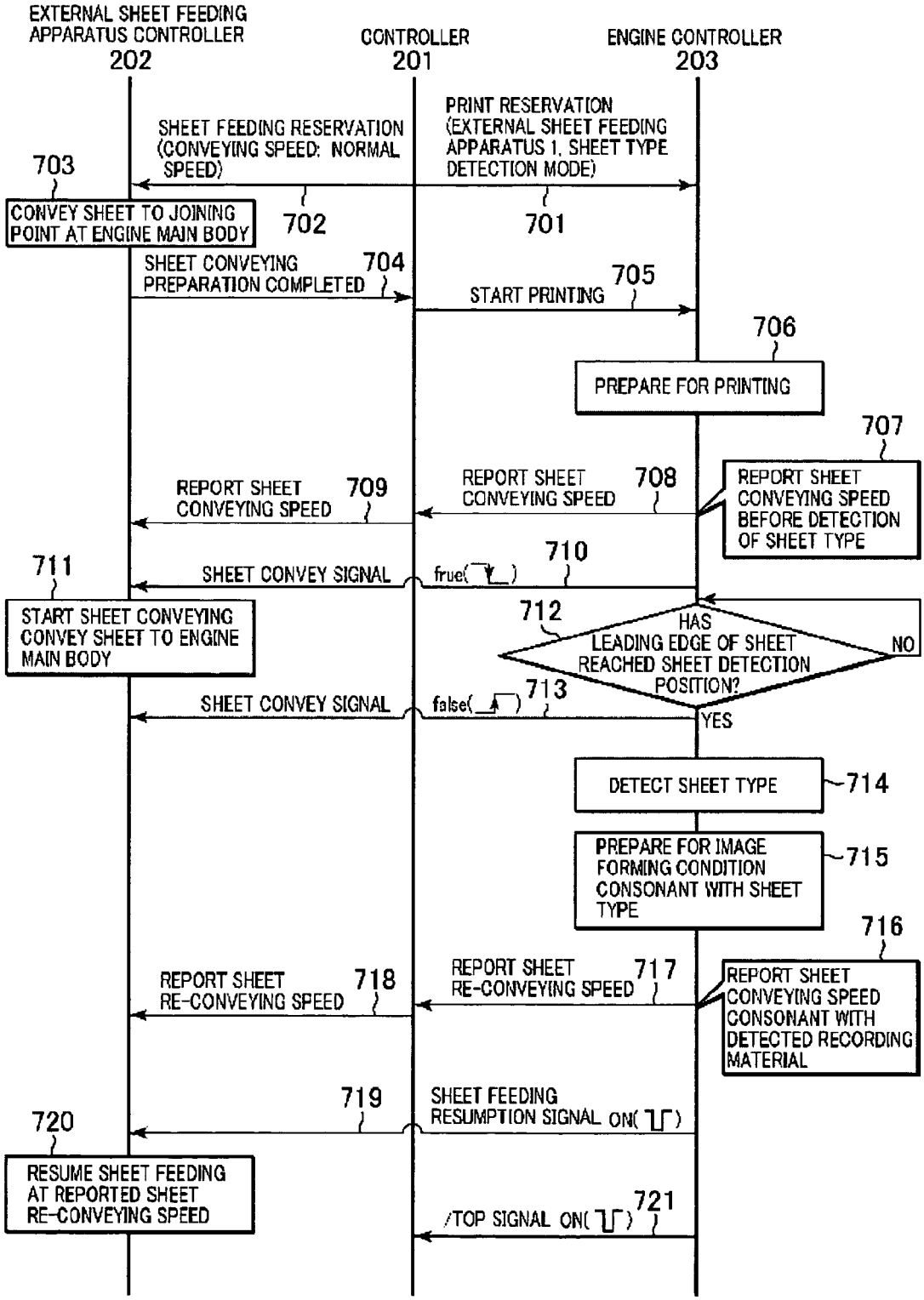
FIG. 3 is a diagram showing the control processing performed by a controller, an engine controller and an external sheet feeding apparatus controller of the first embodiment.
Figure 4:
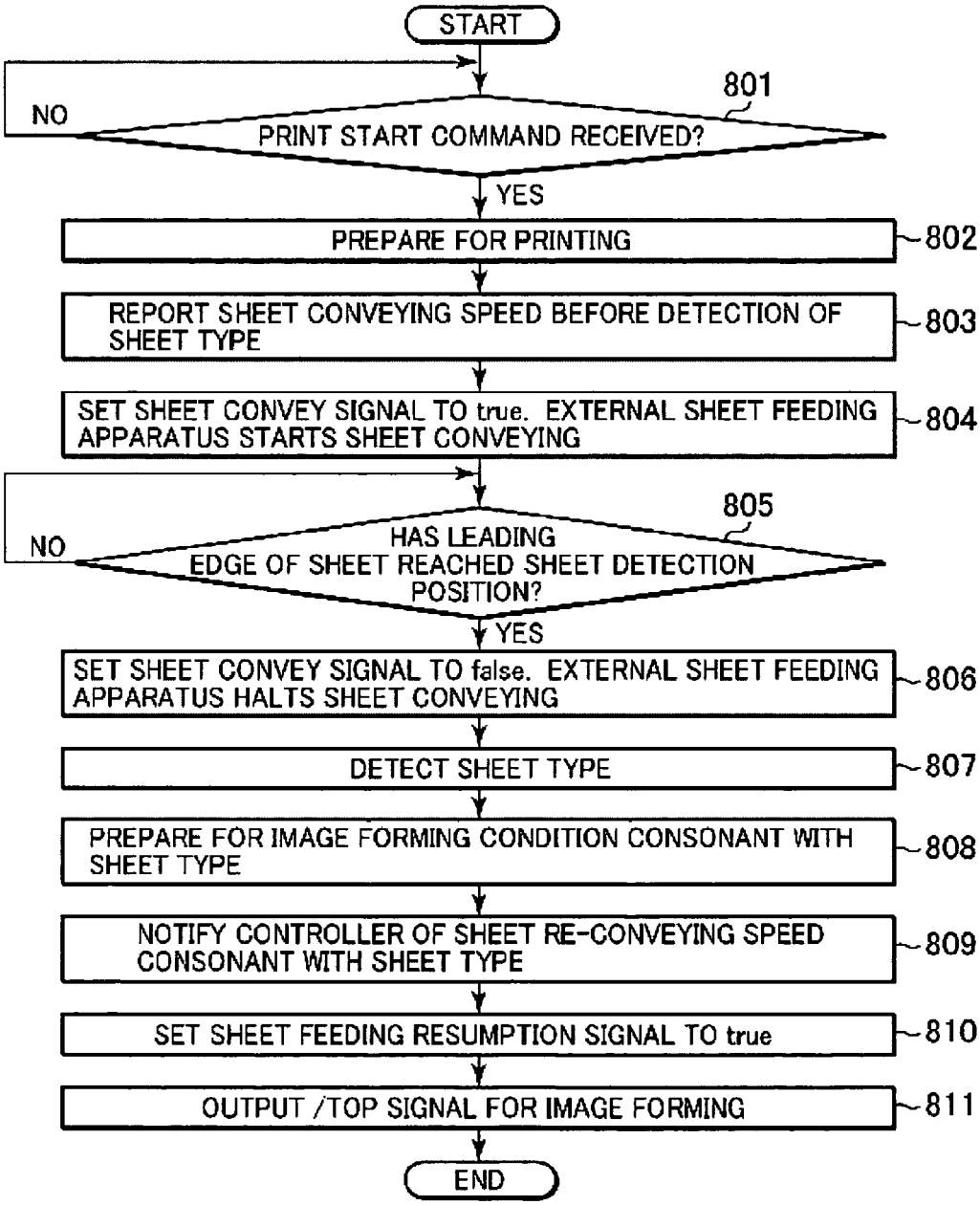
FIG. 4 is a flowchart showing the control processing performed by the engine controller of the first embodiment.

FIG. 3 is a diagram showing the control processing performed by the controller 201 and the engine controller 203, and FIG. 4 is a flowchart showing example control processing performed by the engine controller 203.

The control operations performed by the controller 201, the engine controller 203 and the external sheet feeding apparatus controller 202 will now be explained while referring to FIGS. 3 and 4.

The controller 201 transmits a print reservation command to the engine controller 203 (701) and a sheet feeding reservation command to the external sheet feeding apparatus controller 202 (702).

Upon receiving the sheet feeding reservation command, the external sheet feeding apparatus controller 202 employs the cassette pickup rollers 21*b* to separate and supply sheets, one by one, from the external sheet feeding apparatus 20*b*, and employs the convey rollers 22*b* and the intermediate convey rollers 23*b* to convey sheets individually to the juncture 24 (see FIG. 2), whereat the engine main body is joined (703). When the conveying of the sheet to the juncture 24 has been completed, a notification indicating the sheet conveying operation has ended is transmitted to the controller 201 (704). During this processing, the sheet feeding reservation command includes conveying speed information that includes a normal speed. The normal speed information includes a default speed that is designated for the conveying of plain paper.

Upon receiving the notification to prepare for the conveying of sheets, the controller 201 transmits a print start command to the engine controller 203 (705).

When the engine controller 203 receives the print start command from the controller 201 (801), the engine controller 203 prepares to perform printing (706 and 802). Then, the engine controller 203 transmits to the controller 201 speed information related to a sheet conveying speed at which the sheet held at the juncture 24 (see FIG. 2) is to be conveyed by the intermediate rollers 23*b* and 23*a* (707, 708 and 803). Following this, the controller 201 transmits, to the external sheet feeding apparatus controller 202, the received speed information related to the sheet conveying speed (709), and thereafter, sets a sheet conveying signal to true (710 and 804).

When the sheet conveying signal has been set to true, the external sheet feeding apparatus controller 202 employs the intermediate convey rollers 23*b* and 23*a* to convey the sheet held at the juncture 24 (see FIG. 2) at the sheet conveying speed that has been provided (711). When the leading edge of the sheet is detected by the registration sensor 11, located downstream of the registration rollers 15 (712 and 805), the sheet conveying signal is set to false (713 and 806), and the conveying of the sheet is halted. In this state, the leading edge of the sheet is gripped by the registration rollers 15.

The engine controller 203 permits the sheet type detection sensor 12, located between the intermediate convey rollers 23*a* and the registration rollers 15, to detect the sheet, for which conveying has temporarily been halted (714 and 807), and to determine the sheet type. Then, the engine controller 203 alters the image forming condition to conform with the established sheet type (including a change to a sheet re-conveying speed that has been correlated in advance) (715 and 808). As a newly designated image forming condition, the engine controller 203 transmits speed information related to the sheet re-conveying speed to the controller 201 (716, 717 and 809), and the controller 201 notifies the external sheet feeding apparatus controller 202 of the sheet re-conveying speed (718). After the transmission of the notification and the preparation of the image forming condition, the engine controller 203 outputs a sheet feeding resumption signal (719 and 810). Here, the sheet re-conveying speed is an image forming speed for forming an image on recording material.

When the sheet feeding resumption signal is output by the engine controller 203, the external sheet feeding apparatus controller 202 resumes the conveying of the sheet by the registration rollers 15 at the previously notified sheet re-conveying speed (720). Thereafter, the engine controller 203 outputs a vertical sync signal (a /TOP signal) to permit the controller 201 to output image data (721 and 811).

As described above, when a sheet is to be conveyed to the registration rollers 15, the speed at which it is conveyed by the convey rollers 22*b* and the intermediate convey rollers 23*b* of the external sheet feeding apparatus 20*b* equals the speed of the conveying performed by the intermediate convey rollers 23*a* of the main body sheet feeding unit 20*a*. Further, when the sheet is to be conveyed from the registration rollers 15, the speed at which it is conveyed by the registration rollers 15 and the intermediate convey rollers 23*a* of the main body sheet feeding unit 20*a* equals that of the speed at which conveyed by the convey rollers 22*b* and the intermediate convey rollers 23*b* of the external sheet feeding apparatus 20*b*. Therefore, the occurrence, for example, of a paper jam can be prevented and/or reduced in the main body of the engine.

Second Embodiment

A second embodiment of the present invention differs from the first embodiment in that even when multiple print reservation commands and sheet feeding reservation commands are transmitted in advance, prior to the sequential printing, an engine controller 203 provides for a controller 201 of a sheet conveying speed before and after the sheet type detection is performed for each sheet. Through this processing, the controller 201 can easily determine to which previously, or subsequently, notified sheet conveying speed the detected sheet type corresponds.

Specifically, the feature of this embodiment is that the engine controller 203 either notifies the controller 201 which sheets, designated by which print reservation command, correspond to the conveying speed before the detection of the sheet type, or notifies the controller 201 which sheets, designated by which print reservation command, correspond to the conveying speed after the detection of the sheet type.

For each sheet, correlated with each other, the controller 201 either manages a print reservation command for the engine controller 203 or a sheet feeding reservation command for an external sheet feeding apparatus controller 202. Therefore, based on sheet page information received from the engine controller 203, the conveying speed for each sheet can be obtained.

Figure 5:
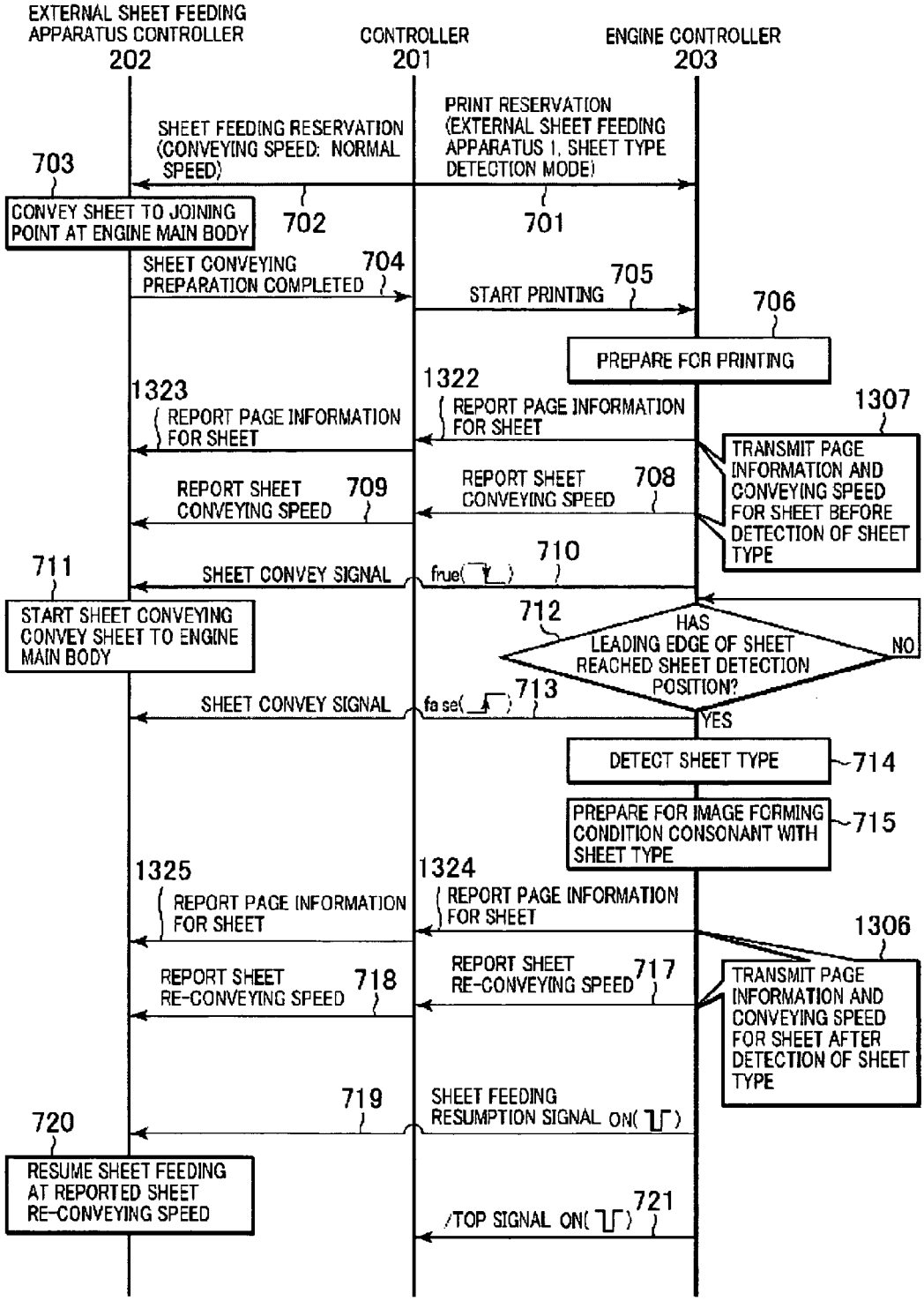
FIG. 5 is a diagram showing the control processing performed by a controller, an engine controller and an external sheet feeding apparatus controller according to a second embodiment of the present invention.
Figure 6:
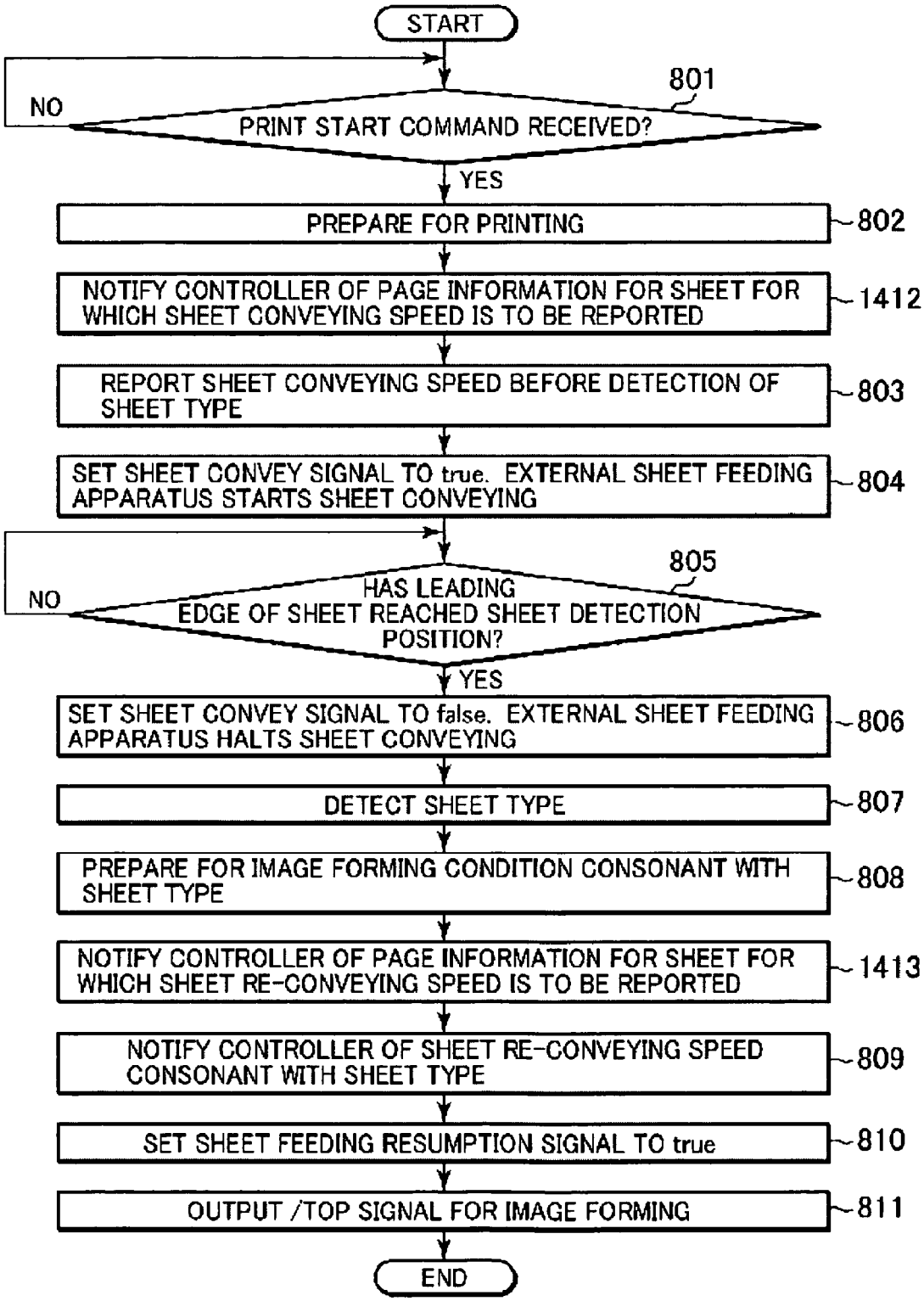
FIG. 6 is a flowchart showing the control processing performed by the engine controller of the second embodiment.

FIG. 5 is a diagram showing the control processing performed by the controller 201, the engine controller 203 and the external sheet feeding apparatus controller 202, and FIG. 6 is a flowchart showing the control processing performed by the engine controller 203. In FIG. 5, 701 to 706 and 708 to 721 show the same steps as those in FIG. 3, and in FIG. 6, 801 to 811 show the same steps as those in FIG. 4.

The control operation performed by the controller 201, the engine controller 203 and the external sheet feeding apparatus controller 202 will now be explained while referring to FIGS. 5 and 6.

The controller 201 transmits a print reservation command to the engine controller 203 (701), and transmits a sheet feeding reservation command to the external sheet feeding apparatus controller 202 (702).

Upon receiving the sheet feeding reservation command, the external sheet feeding apparatus controller 202 begins the pickup process for a sheet, and then conveys the sheet to a junction 24 (see FIG. 2), whereat the path through the main body of the engine is joined, and when the conveying of the sheet has been completed, transmits to the controller 201 a notification indicating that the preparatory sheet conveying has been completed (704). In this case, the sheet feeding reservation command includes conveying speed information that indicates the normal speed. The normal speed information is speed information in which a default speed is designated for the conveying of plain paper.

The engine controller 203 receives the print start command from the controller (705 and 801), prepares to perform printing (706 and 802), and transmits to the controller 201 page information for the sheet being held at the juncture 24 (see FIG. 2), whereat the path through the engine main body j is joined (1307, 1322 and 1412). The controller 201 then transmits to the external sheet feeding apparatus controller 202 the page information for the sheet that has been received from the engine controller 203 (1323).

The engine controller 203 thereafter transmits to the external sheet feeding apparatus controller 202, via the controller 201 (1307 and 708), speed information related to the sheet conveying speed for the sheet held at the juncture 24 (see FIG. 2), whereat the path through the engine main body is joined, that is to be conveyed up to the sheet detection position (709 and 803). Thereafter, the sheet conveying signal is set to true (710 and 804).

When the sheet conveying signal is set to true, the external sheet feeding apparatus controller 202 conveys the sheet to the engine main body at the previously notified sheet conveying speed (711).

When the supplied sheet has reached the sheet detection position (712 and 805), the engine controller 203 sets the sheet conveying signal to false (713 and 806), and halts the conveying of the sheet.

The engine controller 203 then detects the sheet type while the conveying of the sheet is temporarily halted (714 and 807). After the sheet type has been determined, the engine controller 203 changes the image forming condition (including the sheet conveying speed) in consonance with the type of sheet identified (715 and 808). Following this, page information for the sheet for which the type has been detected, and speed information related to the sheet conveying speed (the sheet re-conveying speed), consonant with the detected sheet type, are transmitted via the controller 201 (1306, 1324, 717 and 1413) to the external sheet feeding apparatus controller 202 (1325, 718 and 809). After the image forming condition has been changed, the engine controller 203 outputs a sheet feeding resumption signal (719 and 810), to resume the conveying of the sheet, and outputs a vertical sync signal (a /TOP signal) to permit the controller 201 to output image data (721 and 811). Here, the sheet re-conveying speed is an image forming speed for forming an image on a recording material.

When the sheet feeding resumption signal is received, the external sheet feeding apparatus controller 202 resumes the conveying of the sheet at the sheet conveying speed (the sheet re-conveying speed) for which notification was previously received (720).

As described above, even when multiple print reservation commands and print reservation commands have previously been transmitted for sequential printing, for example, the engine controller 203 notifies the controller 201 which sheets correspond to the sheet conveying speed obtained before or after the detection of the sheet type. Therefore, the controller 201 can easily identify which sheets correspond to the sheet conveying speed received before or after the detection of the sheet type, and disagreements as to the sheet conveying speeds, between the engine main body and the external sheet feeding apparatus, can be more appropriately prevented.

Third Embodiment

Figure 7:
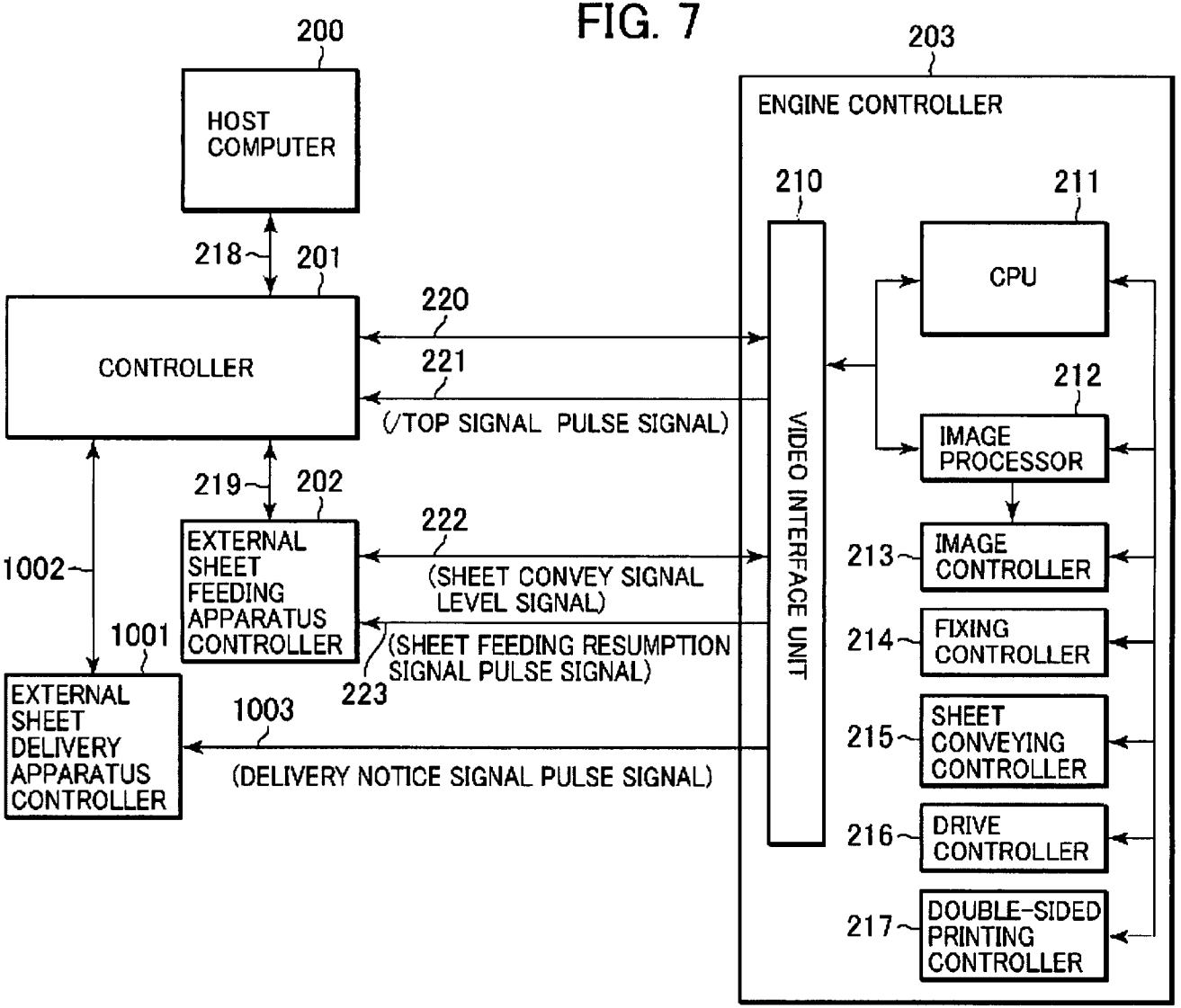
FIG. 7 is a block diagram showing a third embodiment of the present invention.
Figure 8:
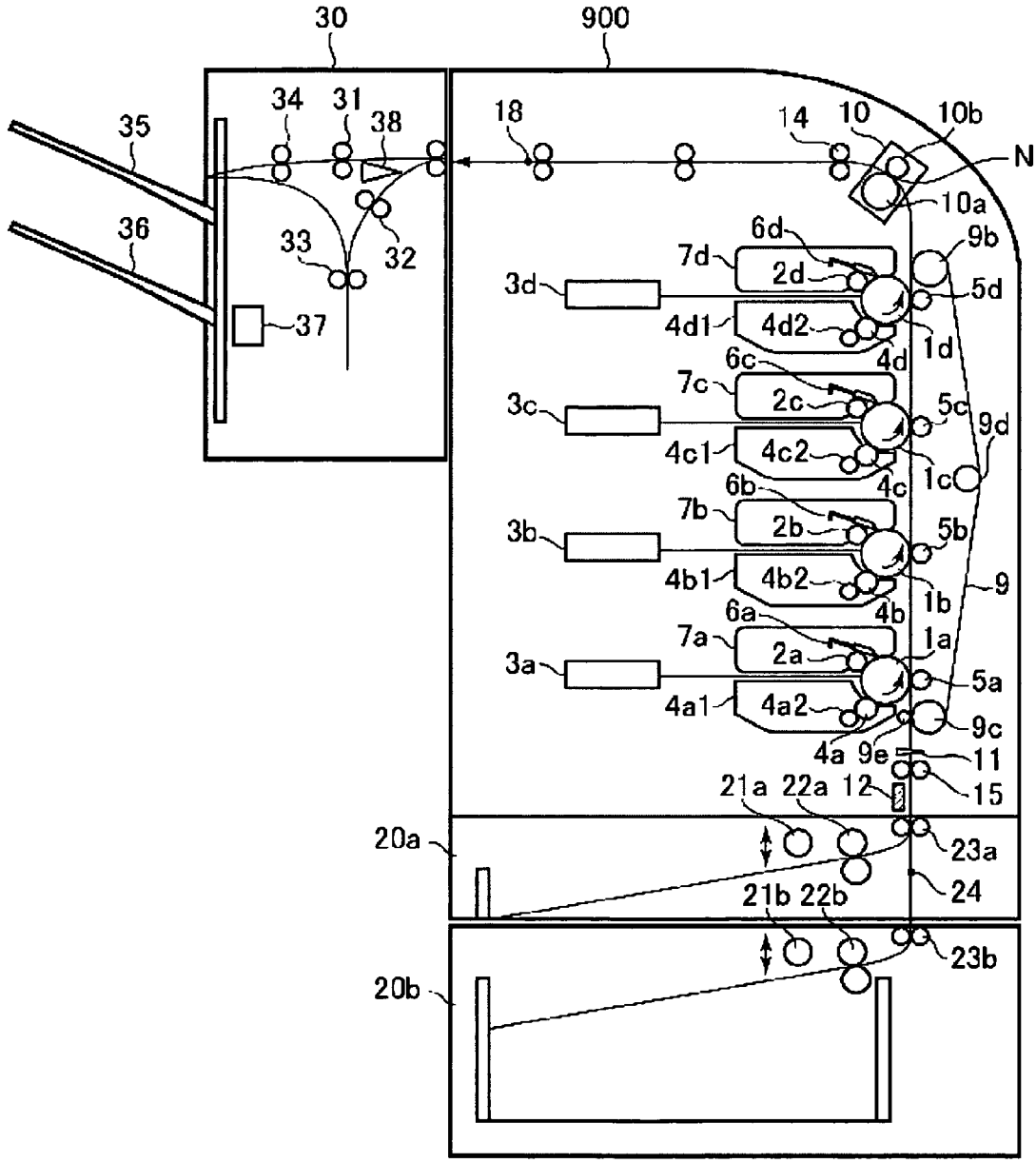
FIG. 8 is a cross-sectional view of the structure of a color laser beam printer in FIG. 7.

FIG. 7 is a diagram showing a color laser beam printer according to a third embodiment of the present invention. The configuration of the color laser beam printer for this embodiment is as shown in FIG. 8. That is, the third embodiment differs from the first embodiment in that an external sheet delivery apparatus 30 is provided instead of the sheet discharge area 13 in FIG. 2.

This embodiment further differs from the first embodiment in that after the sheet type has been detected, a speed is determined for conveying a sheet to the external sheet delivery apparatus 30, and for this sheet conveying speed, a notification is issued that it matches the conveying speeds of the engine main body and the external sheet delivery apparatus 30, which is an optional sheet delivery apparatus that can be detached from the image forming apparatus.

In FIG. 7, the same reference numerals are used as are employed in FIG. 1 to denote corresponding portions, and in FIG. 8, the same reference numerals are used as are employed in FIG. 2 to denote corresponding portions.

The external sheet delivery apparatus 30 handles a sheet conveyed from a color laser beam printer 900 in accordance with an instruction issued by a controller 201, such as a face up or face down instruction. That is, based on the instruction received from the controller 201, the external sheet delivery apparatus 30 inverts the sheet using a flapper 38, or vertically moves a first discharge bin 35 and a second discharge bin 36, using a bin elevation motor 37, to sort and stack sheets.

When a face up instruction is issued by the controller 201, a sheet is guided by rollers 31 directly to a discharge port. When, however, a face down instruction is issued by the controller 201, a sheet is guided by the flapper 38 to rollers 32 and 33 and is conveyed until the trailing edge of the sheet passes the rollers 32. Then, the rollers 32 are reversely rotated, and beginning with the trailing edge, the sheet is conveyed to rollers 34 and is guided to the discharge port.

Referring to FIG. 7, the controller 201 can communicate with a host computer 200, an external sheet feeding apparatus controller 202, an engine controller 203 and an external sheet delivery apparatus controller 1001 along communication lines 218, 219, 220 and 1002. The controller 201 receives image information and a print instruction from the host computer 200, analyzes the received image information and converts the information into bit data. Then, the controller 201 transmits the bit data for each sheet via a video interface unit 210 to the engine controller 203 as a print reservation command, a print start command or a video signal.

In accordance with the print instruction received from the host computer 200, the controller 201 transmits a print reservation command to the engine controller 203, and when the sheet is to be delivered to the external sheet delivery apparatus 30, transmits a sheet delivery reservation command to the external sheet delivery apparatus controller 1001. The controller 201 manages, for each sheet, the print reservation command and the sheet delivery reservation command in correlation with each other. When printing is enabled, the controller 201 transmits a print start command to the engine controller 203.

Upon receiving the print start command, the engine controller 203 starts the feeding of sheets, and at the sheet detection position, temporarily halts the feeding operation to detect the sheet type. After the sheet type has been detected, the engine controller 203 resumes the conveying of the sheet, outputs a /TOP signal (221 in FIG. 7), which is used as a timing reference for outputing a video signal, and starts a printing operation. Then, when the leading edge of the sheet has reached a delivery notice position 18 (see FIG. 8), a delivery notice signal is output to the external sheet delivery apparatus 30 (1003). When the delivery notice signal is output (1003 in FIG. 7), the external sheet delivery apparatus 30 begins to prepare for acceptance of the sheet.

For this embodiment, an explanation will now be given for example processing for the issue of the delivery notice to the external delivery apparatus controller 1001 along independent signal lines. However, the delivery notice may be transmitted along a communication line from the engine controller 203, via the controller 201, to the external sheet delivery apparatus controller 1001. Alternatively, a communication line may be provided between the engine controller 203 and the external sheet delivery apparatus controller 1001, so that the engine controller 203 can directly issue the delivery notice to the external sheet delivery apparatus controller 1001.

Since the engine controller 203 is the same as that in FIG. 1, no further explanation for it will be given.

Figure 9:
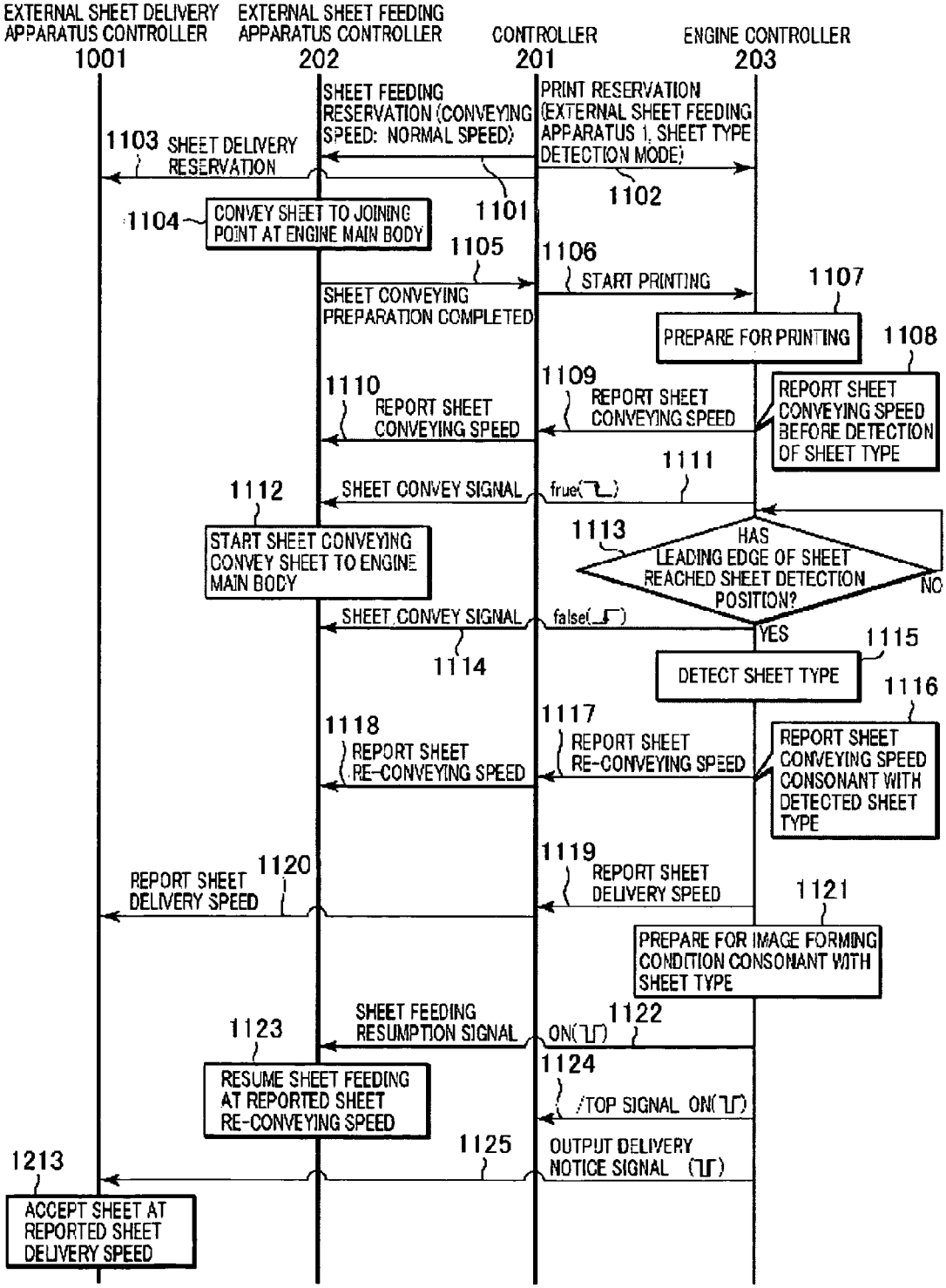
FIG. 9 is a diagram showing the control processing performed by a controller, an engine controller, an external sheet feeding apparatus controller and an external sheet delivery apparatus controller of the third embodiment.
Figure 10:
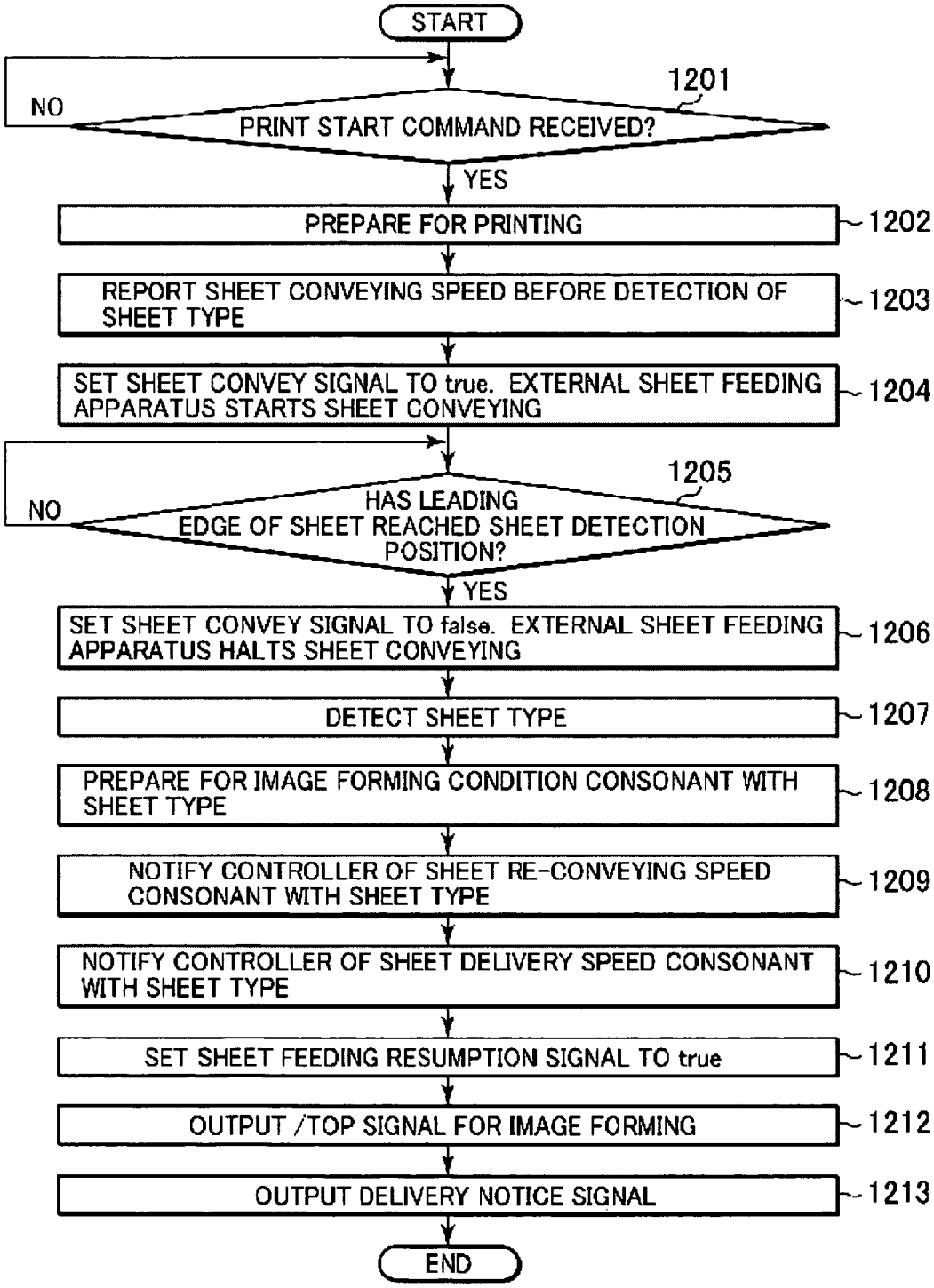
FIG. 10 is a flowchart showing the control processing performed by the engine controller of the third embodiment.

FIG. 9 is a diagram showing the control processing performed by the controller 201, the external sheet feeding apparatus controller 202, the engine controller 203 and the external sheet delivery apparatus controller 1001, and FIG. 10 is a flowchart showing the control processing performed by the engine controller 203.

The control operations performed by the controller 201, the external sheet feeding apparatus controller 202, the engine controller 203 and the external sheet delivery apparatus controller 1001 will now be explained while referring to FIGS. 9 and 10.

The controller 201 transmits a sheet feeding reservation command to the external sheet feeding apparatus controller 202 (1101), a print reservation command to the engine controller 203 (1102), and a sheet delivery reservation command to the external sheet delivery apparatus controller 1001 (1103).

Upon receiving the sheet feeding reservation command, the external sheet feeding apparatus controller 202 begins the pickup of sheets, conveys a sheet to the juncture 24 (see FIG. 8), where the engine main body is joined (1104), and at the end of the sheet conveying, transmits a notification to the controller 201 indicating that the sheet conveying process has ended (1105). Here, the sheet feeding reservation command includes conveying speed information indicating normal speed. The normal speed information is speed information in which a default speed is designated for the conveying of plain paper.

Thereafter, the engine controller 203 receives a print start command from the controller 201 (1106 and 1201), and prepares to perform the printing (1107 and 1202). Thereafter, the engine controller 203 transmits to the external sheet feeding apparatus controller 202, via the controller 201, speed information related to a sheet conveying speed at which the sheet held at the juncture 24 (see FIG. 8), whereat the engine main body is joined, is to be conveyed to the sheet detection point. Following this, the sheet conveying signal is set to true (1108, 1109, 1110, 1111, 1203 and 1204).

When the sheet conveying signal is set to true, the external sheet feeding apparatus controller 202 conveys the sheet to the engine main body at the previously received sheet conveying speed (1112).

When the sheet has reached the sheet detection position (1113 and 1205), the engine controller 203 sets the sheet convey signal to false (1114 and 1206) and halts the conveying of the sheet.

The engine controller 203 detects the sheet type while the conveying if the sheet is temporarily halted (1115 and 1207). After the sheet type has been identified, the engine controller 203 changes the image forming condition (including the sheet conveying speed) so it conforms with the sheet type. Then, the speed information related to the sheet conveying speed (the sheet re-conveying speed) consonant with the established sheet type is transmitted via the controller 201 (1116 and 1117) to the external sheet feeding apparatus controller 202 (1118, 1208 and 1209). Further, the speed information related to a speed (a sheet delivery speed) for delivery to the external sheet delivery apparatus 30, which is consonant with the sheet type identified, is transmitted via the controller 201 (1119) to the external sheet delivery apparatus controller 1001 (1120 and 1210).

The engine controller 203 changes the image forming condition (1121), outputs a sheet feeding resumption signal to resume sheet conveying (1122 and 1211), and outputs a vertical sync signal (a /TOP signal) to permit the controller 201 to output image data (1124 and 1212).

When the sheet feeding resumption signal has been output, the external sheet feeding apparatus 20*b* again starts the feeding of sheets at the previously received sheet re-conveying speed (1123).

When the leading edge of the current sheet has reached the delivery notice position 18 (see FIG. 8), the engine controller 203 outputs a delivery notice signal to the external sheet delivery apparatus controller 1001 (1125 and 1213). Upon receiving the delivery notice signal, the external sheet delivery apparatus controller 1001 begins to prepare for the sheet delivered by the engine to be accepted at the speed (sheet delivery speed) previously received for the delivery of the sheet.

As described above, for a color laser beam printer wherein, after the sheet type has been detected, the speed for conveying the sheet to the external sheet delivery apparatus 30 is determined, disagreements relative to the sheet conveying speed between the engine main body and the external sheet delivery apparatus 30 can be prevented.

Fourth Embodiment

A fourth embodiment of the present invention differs from the third embodiment in that, even when multiple print reservation commands and sheet delivery reservation commands are transmitted in advance, for example, for sequential printing, a controller 201 can easily determine which sheets correspond to a sheet delivery speed transmitted by an engine controller 203.

Specifically, after the sheet type has been detected, the engine controller 203 transmits to the controller 201 related sheet delivery speed information that indicates which sheets, designated by which print reservation command, are consonant.

For each sheet, the controller 201 manages a print reservation command, for the engine controller 203, and a sheet delivery reservation command, for an external sheet delivery apparatus controller 1001, that are consonant with each other. Therefore, the controller 201 need only obtain, from the engine controller 203, page information for a sheet, for the sheet delivery speed, for sheets to be delivered to an external sheet delivery apparatus 30, to be obtained.

Figure 11:
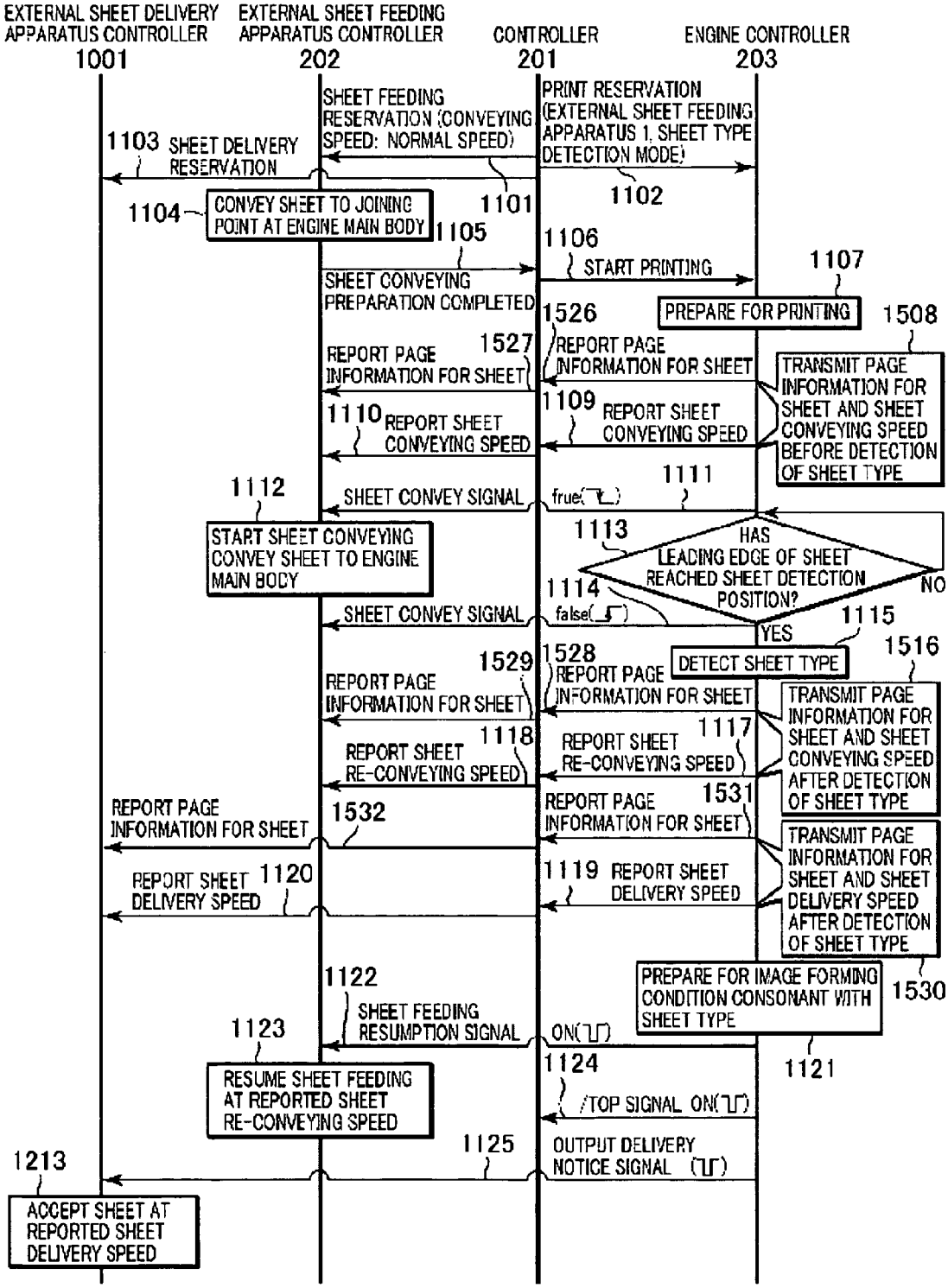
FIG. 11 is a diagram showing the control processing performed by a controller, an engine controller, an external sheet feeding apparatus controller and an external sheet delivery apparatus controller according to a fourth embodiment of the present invention.
Figure 12:
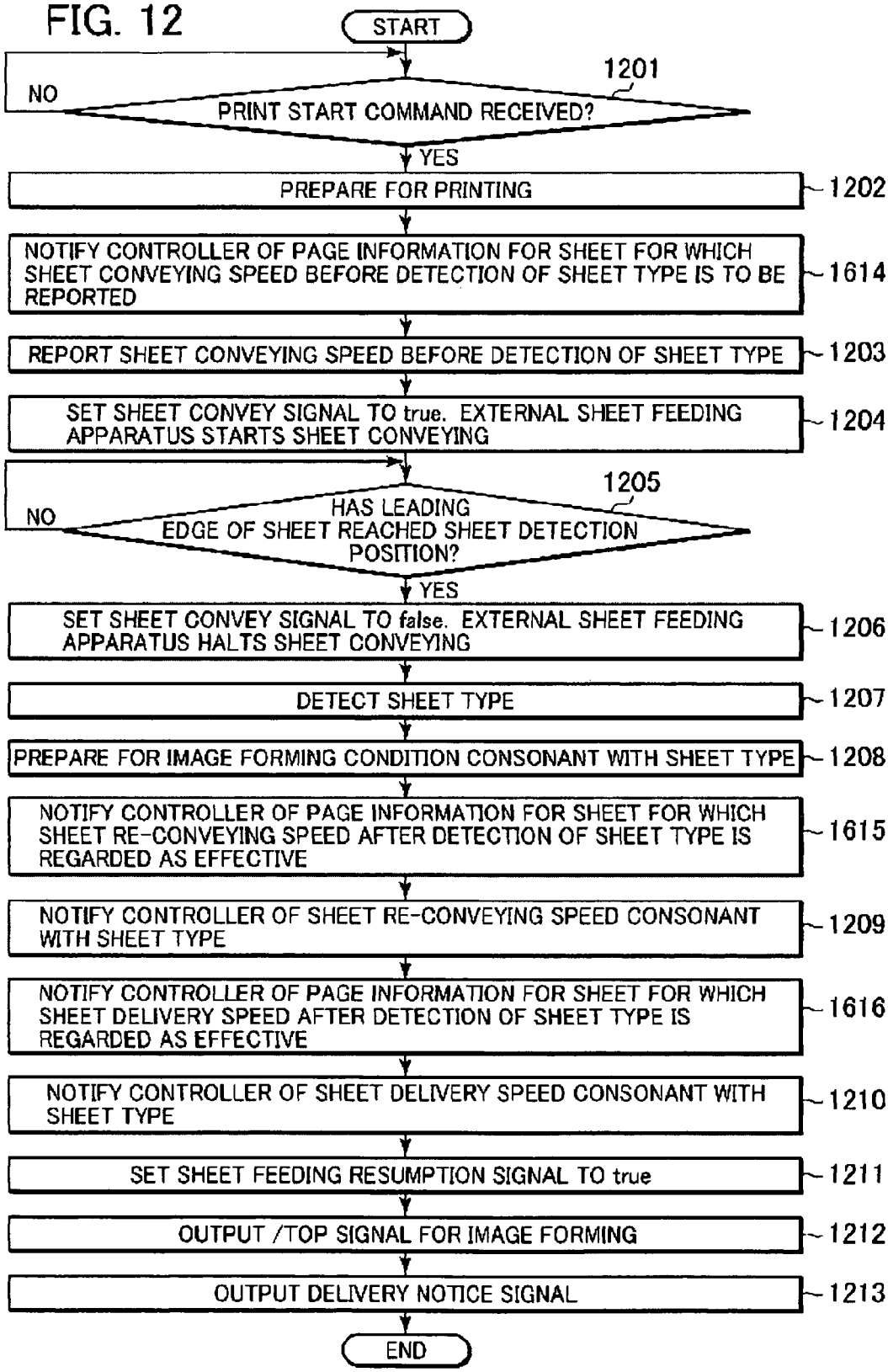
FIG. 12 is a flowchart showing the control processing performed by an engine controller according to a fifth embodiment of the present invention.
Figure 13A:
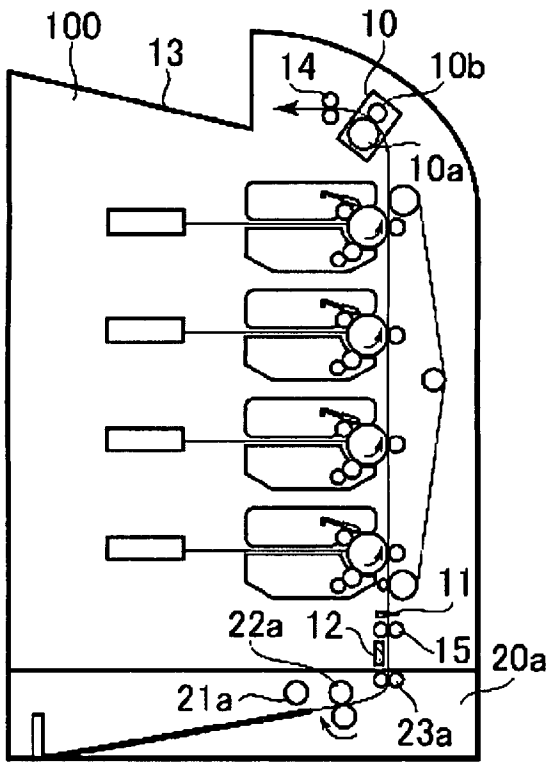
FIG. 13A PRIOR ART
FIGS. 13A to 13C are diagrams for explaining the feeding of sheets from the main body sheet feeding unit in a conventional image forming apparatus.
Figure 13B:
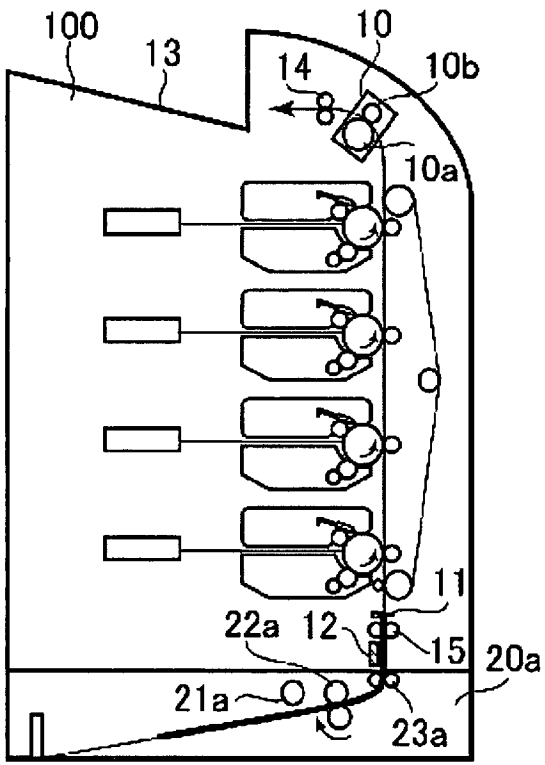
FIG. 13B PRIOR ART
Figure 13C:
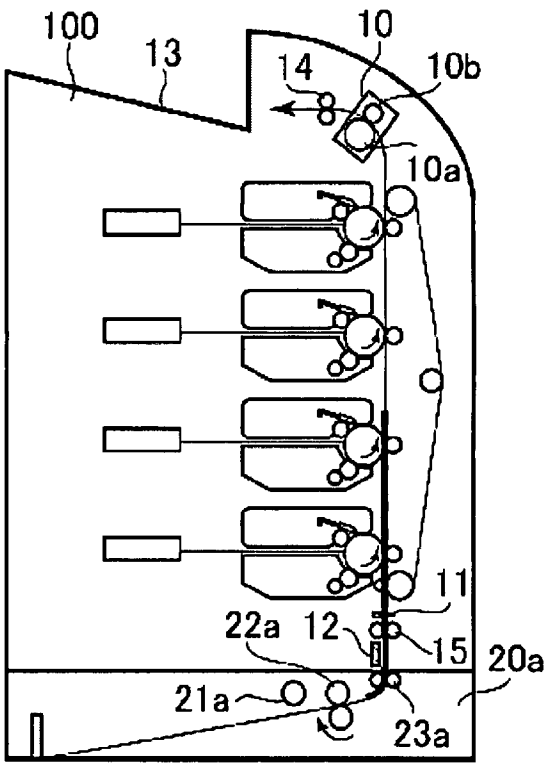
FIG. 13C PRIOR ART
Figure 14:
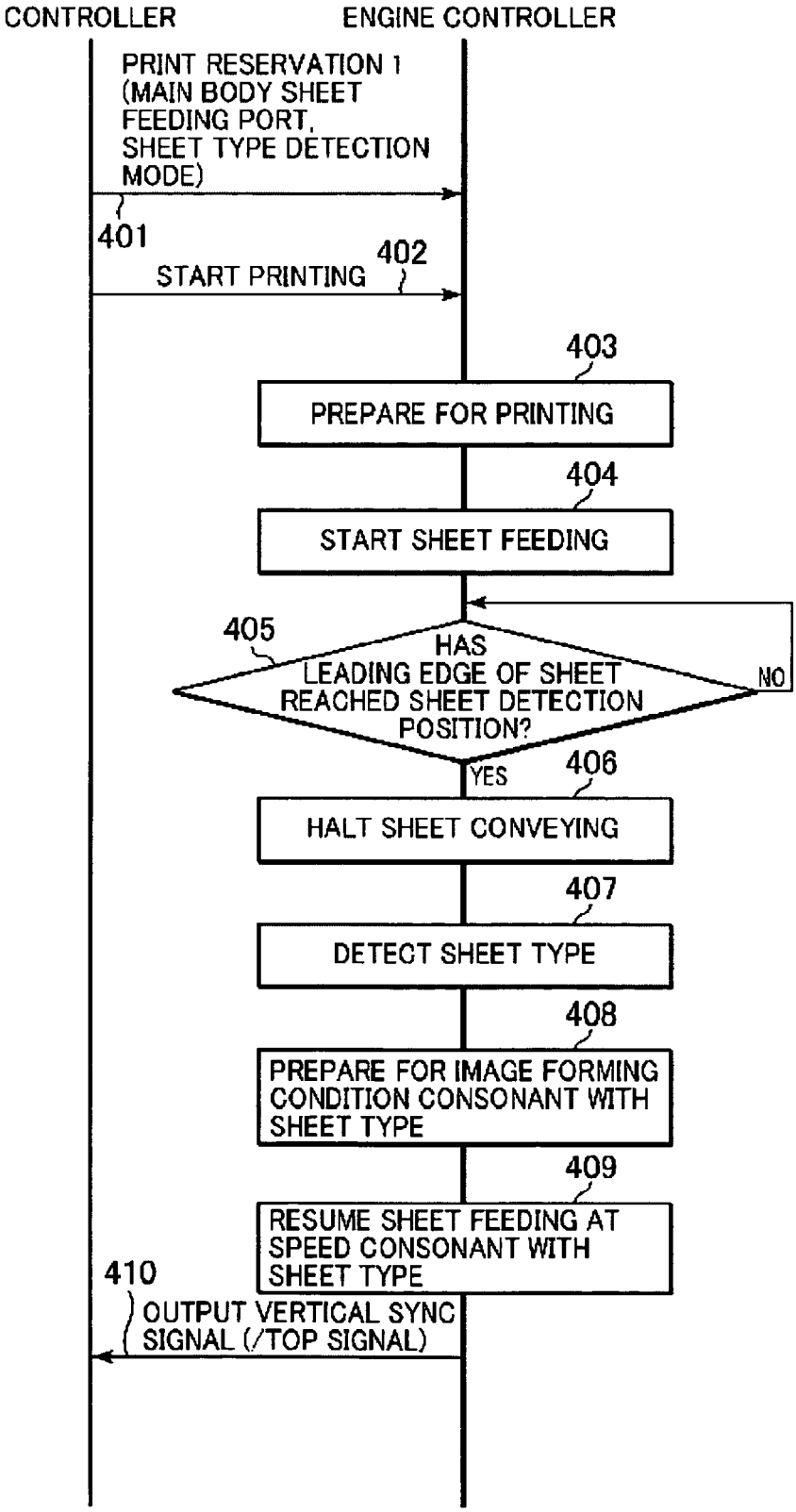
FIG. 14 PRIOR ART
FIG. 14 is a diagram showing the conventional control processing performed by a controller and an engine controller.
Figure 15A:
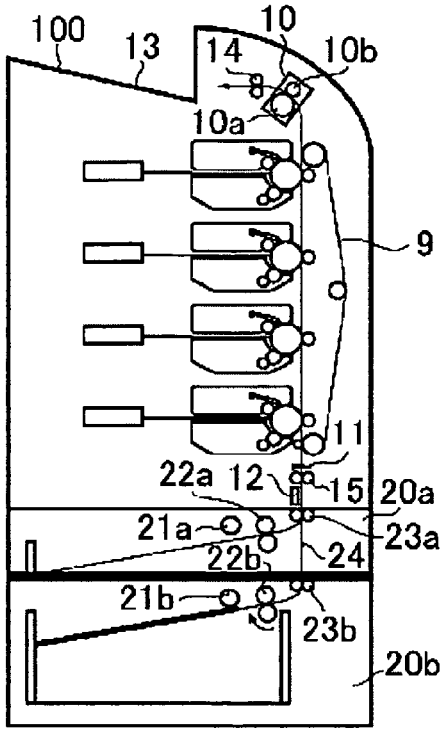
FIG. 15A PRIOR ART
FIGS. 15A to 15D are diagrams for explaining a conventional process for feeding a sheet from an external sheet feeding apparatus.
Figure 15B:
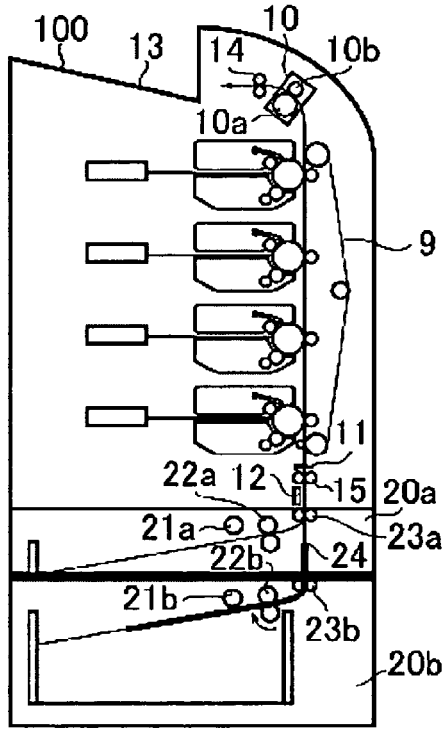
FIG. 15B PRIOR ART
Figure 15C:
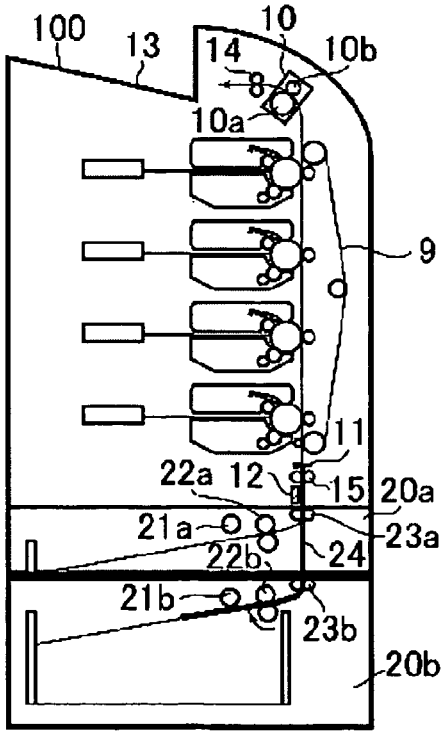
FIG. 15C PRIOR ART
Figure 15D:
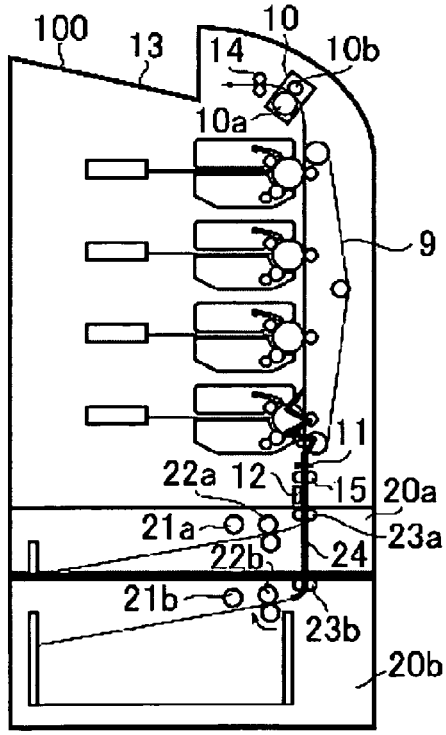
FIG. 15D PRIOR ART
Figure 16:
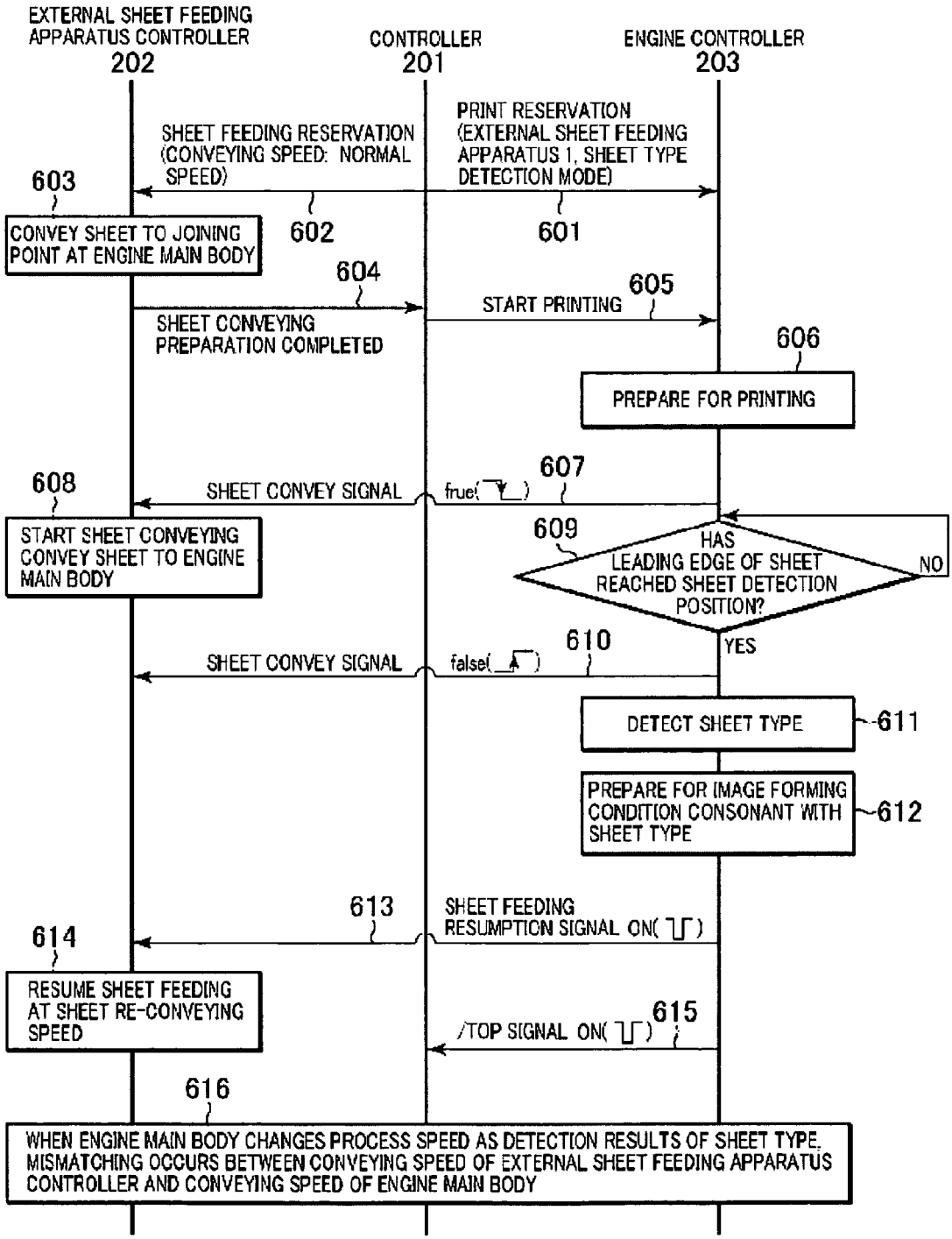
FIG. 16 PRIOR ART
FIG. 16 is a diagram showing the conventional control processing performed by the controller, the engine controller and an external sheet feeding apparatus controller.

FIG. 11 is a diagram showing the control processing performed by the controller 201, the engine controller 203, the external sheet feeding apparatus controller 202 and the external sheet delivery apparatus controller 1001, and FIG. 12 is a flowchart showing the control processing performed by the engine controller 203. In FIG. 11, 1101 to 1107, 1109 to 1115 and 1117 to 1125 correspond to those in FIG. 9, and in FIG. 12, 1201 to 1213 are the same as those in FIG. 10.

The control operations performed by the controller 201, the engine controller 203 and the external sheet delivery apparatus controller 1001 will now be described while referring to FIGS. 11 and 12.

The controller 201 transmits a sheet feeding reservation command to the external sheet feeding apparatus controller 202 (1101), a print reservation command to the engine controller 203 (1102), and a sheet delivery reservation command to the external sheet delivery apparatus controller 1001 (1103).

Upon receiving the sheet feeding reservation command, the external sheet feeding apparatus controller 202 begins the pickup of sheets, conveys a sheet to the juncture 24 (see FIG. 8), whereat the engine main body is joined, and transmits, at the end of the sheet conveying, a notification to the controller 201 indicating that the sheet conveying process has ended (1105). Here, the sheet feeding reservation command includes conveying speed information in which the normal speed is indicated. The normal speed information is speed information in which a default speed is designated for the conveying of plain paper.

Then, the engine controller 203 receives a print start command from the controller 201 (1106 and 1201), and prepares to perform printing (1107 and 1202). Thereafter, page information for a sheet held at the juncture 24 (see FIG. 8), whereat the engine main body is joined, is transmitted to the controller 201 (1508, 1526 and 1614). Also, the controller 201 transmits to the external sheet feeding apparatus controller 202 page information for the sheet received from the engine controller 203 (1527).

The engine controller 203 notifies the external sheet feeding apparatus controller 202, via the controller 201 (1508, 1109 and 1203), of the sheet conveying speed at which the sheet held at the juncture 24 (see FIG. 8), whereat the engine main body is joined, is to be conveyed to the sheet detection position (1110). Also thereafter, the sheet conveying signal is set to true (1111 and 1204).

When the sheet conveying signal is set to true, the external sheet feeding apparatus controller 202 conveys the sheet to the engine main body at the sheet conveying speed that has been received (1112).

When the sheet has reached the sheet detection position (1113 and 1205), the engine controller 203 sets the sheet conveying signal to false (1114 and 1206) and halts the conveying of the sheet.

The engine controller 203 then detects the sheet type, while temporarily halting the conveying of the sheet (1115 and 1207). After the sheet type has been identified, the engine controller 203 changes the image forming condition (the sheet conveying speed) so it is consonant with the sheet type that was identified (1208). Then, the page information for the current sheet and the sheet conveying speed (the sheet re-conveying speed) consonant with the sheet type that was determined are transmitted, via the controller 201 (1516, 1528, 1117 and 1615), to the external sheet feeding apparatus controller 202 (1529, 1118 and 1209). Furthermore, the page information for the sheet and the conveying speed (the sheet delivery speed), which is consonant with the sheet type identified, for delivering the sheet to the external sheet delivery apparatus 30 are transmitted, via the controller 201 (1530, 1531, 1119, 1616 and 1210), to the external sheet delivery apparatus controller 1001 (1532 and 1120).

The engine controller 203 changes the image forming condition (1121), outputs a sheet feeding resumption signal (1122 and 1211), to resume the conveying of the sheet, and outputs a vertical sync signal (a /TOP signal) to permit the controller 201 to output image data (1124 and 1212).

When the sheet feeding resumption signal has been output, the external sheet feeding apparatus 20*b* resumes the conveying of the sheet at the sheet conveying speed (the sheet re-conveying speed) that has previously been transmitted advance (1123).

When the leading edge of the currently conveyed sheet has reached the delivery notice position 18 (see FIG. 8), the engine controller 203 outputs a delivery notice signal to the external sheet delivery apparatus controller 1001 (1125 and 1213). Upon receiving the delivery notice signal, the external sheet delivery apparatus 30 begins preparations to ensure that the sheet, delivered by the engine, is accepted at the sheet delivery speed that was previously received.

As described above, even when multiple print reservation commands and sheet delivery reservation commands are transmitted in advance for sequential printing, for example, the engine controller notifies the controller which sheets are consonant with the sheet delivery speed obtained after the sheet type has been detected. Therefore, the controller can easily identify which sheets are consonant with the sheet delivery speeds received before and after the sheet type detection is performed, and disagreements, relative to the sheet conveying speed, between the engine main body and the external sheet delivery apparatus can be more appropriately prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2005-126338, filed Apr. 25, 2005 and Japanese Patent Laid-Open No. 2006-095118, filed Mar. 30, 2006, which are hereby incorporated by reference herein in its entirety.

What is claimed is:

1. An image forming system, including an image forming apparatus and a sheet feeding apparatus, comprising:

a first conveying unit configured to convey to the image forming apparatus a recording material fed by the sheet feeding apparatus;

a first controller controlling a first conveying speed at which the first conveying unit is to convey the recording material;

a second conveying unit configured to convey to an image forming unit of the image forming apparatus the recording material conveyed by the first conveying unit;

a detector detecting a type of the recording material while the recording material is halted by the second conveying unit;

a second controller controlling, based on detection result by the detector, a conveying speed so that the second conveying unit conveys the recording material to the image forming unit of the image forming apparatus at a second conveying speed, and transmitting the second conveying speed to the first controller, wherein, based on printing reservation information for the recording material, the first controller conveys the recording material to a predetermined position located prior to reaching the second conveying unit, and during the time after the recording material reaches the predetermined position, and before the recording material fed by the sheet feeding apparatus reaches the second conveying unit, the first controller maintains the first conveying speed for the recording material, and after the recording material reaches the second conveying unit, the first controller controls the conveying speed to be switched to the second conveying speed, when the second conveying speed transmitted from the second controller is different from the first conveying speed; and a sheet delivery apparatus including a delivery unit and another controller, the delivery unit configured to deliver the recording material, and the another controller controlling conveying speeds of the recording material, wherein the another controller controls the recording material to be conveyed at a third conveying speed determined by the second controller.

2. An image forming system according to claim 1, wherein the second controller transmits information related to the third conveying speed to the another controller, and the another controller employs the information received from the second controller to control the conveying speed of the recording material.

* * * * *